US005950556A

United States Patent [19]

Liebe

[11] Patent Number: 5,950,556

[45] Date of Patent: Sep. 14, 1999

[54] SLACK ADJUSTING HANDLE

[76] Inventor: Forest F. Liebe, 2812 N. 15th, Coeur D' Alene, Id. 83814

[21] Appl. No.: 08/906,984

[22] Filed: Aug. 6, 1997

[51] Int. Cl.[6] ..... B63B 39/10

[52] U.S. Cl. ..... 114/230.1; 114/218; 24/115 G; 24/129 B

[58] Field of Search ..... 114/230, 213, 114/217, 218; 24/129 R, 13 D, 115 G, 115 H, 115 M; 188/65.1, 65.2, 65.4, 65.5

[56] References Cited

U.S. PATENT DOCUMENTS

| | | | |
|---|---|---|---|
| 581,853 | 5/1897 | Eakins | 24/115 G |
| 612,636 | 10/1898 | Zusi | 24/129 B |
| 1,541,654 | 6/1925 | O'Brien | 24/129 R |
| 2,142,776 | 1/1939 | Behnke | 24/129 R |
| 2,279,769 | 4/1942 | Bon Horst et al. | 24/523 |
| 2,465,132 | 3/1949 | Surface | 24/115 H |
| 4,220,306 | 9/1980 | Cueto et al. | 24/129 R |
| 4,222,157 | 9/1980 | Forman | 24/129 A |
| 4,288,891 | 9/1981 | Boden | 24/115 G |
| 5,008,981 | 4/1991 | Smithson | 24/115 G |
| 5,365,641 | 11/1994 | Watanabe et al. | 24/115 G |

*Primary Examiner*—Jesus D. Sotelo

[57] ABSTRACT

The snugger bugger slack adjuster is a handle comprising of two mating shell halves containing three parts. A plunger-button, a prong and a spring. The manually operable prong has two upward tines set at 45 degree angles. These tines are set in opposite directions so that when a line is in place, the tines will embed themselves deeply into the lines. When the plunger button is depressed, the prong will disappear into a chamber in the handle allowing the line to move freely. The release clamp is seated within in the handle halves such that the button extends upward through an aperture provided in the handle. When so seated, the spring bears against the underside of the prong, driving it upward which brings the line-engaging tines into contact with a portion of the line that passes through the handle. When so seated the line-engaging tines bear against the lines within the handle and they are unable to be advanced when the plunger-button and prong is in an unbiased position.

4 Claims, 6 Drawing Sheets

SLACK ADJUSTING HANDLE

BACKGROUND OF INVENTION

The need for a new way to tie up boats other than with knots which can become untied.

1. Field of the Invention

The present invention related to the tying up, attaching, anchoring, securing of boats, planes, or any other vehicles or of bundles, load, packaging, or any other items in need of rope, line, cable or other adjustable fixing.

2. Description of the Related Art

The most widely use conventional system for the tying of boats, anchoring of planes and fixing of bundles is to tie a line, or attaching device with the use of knots.

With the use of this handle invention, the lines can be held firmly in place with little or no slippage, whereas a hand tied knot can become undone if not properly tied.

SUMMARY OF THE INVENTION

The present invention proposes a holding of a rope or line securely until, the button is depressed and then the rope or line will move freely in both directions. This process eliminates the need to tie knots in a rope or line. Thusly securing the boat, airplane, or vehicle in much less time.

DETAILED DESCRIPTION

Figure 1:
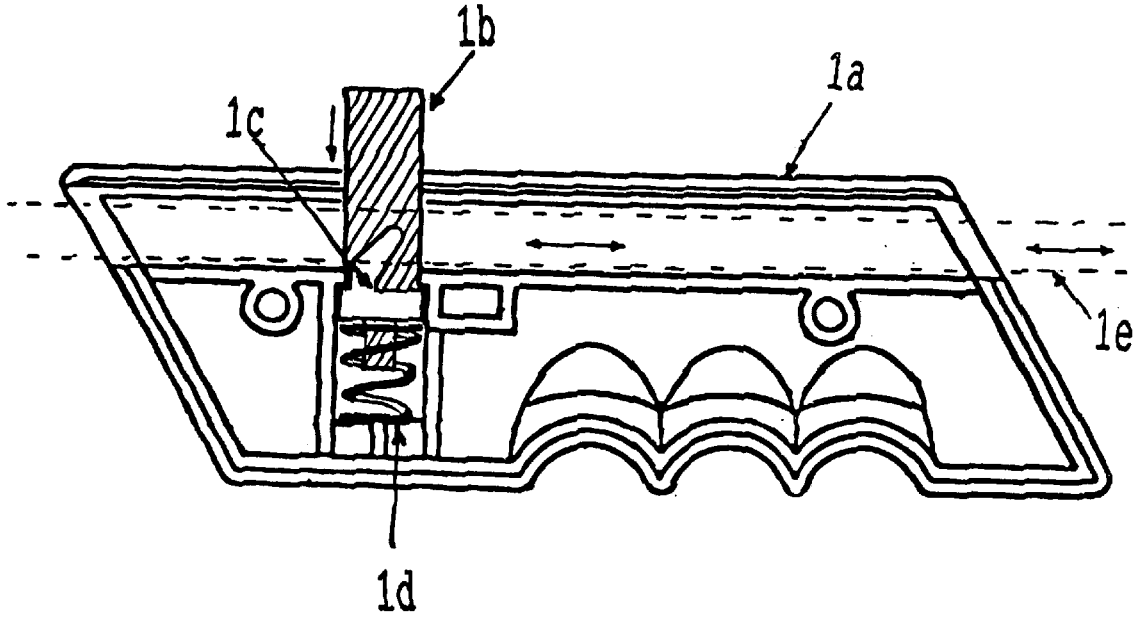
FIG. 1 is a cross-sectional view of the snugger bugger slack adjusting handle with button in normal hold position with the tines of the prong holding the rope.
Figure 2:
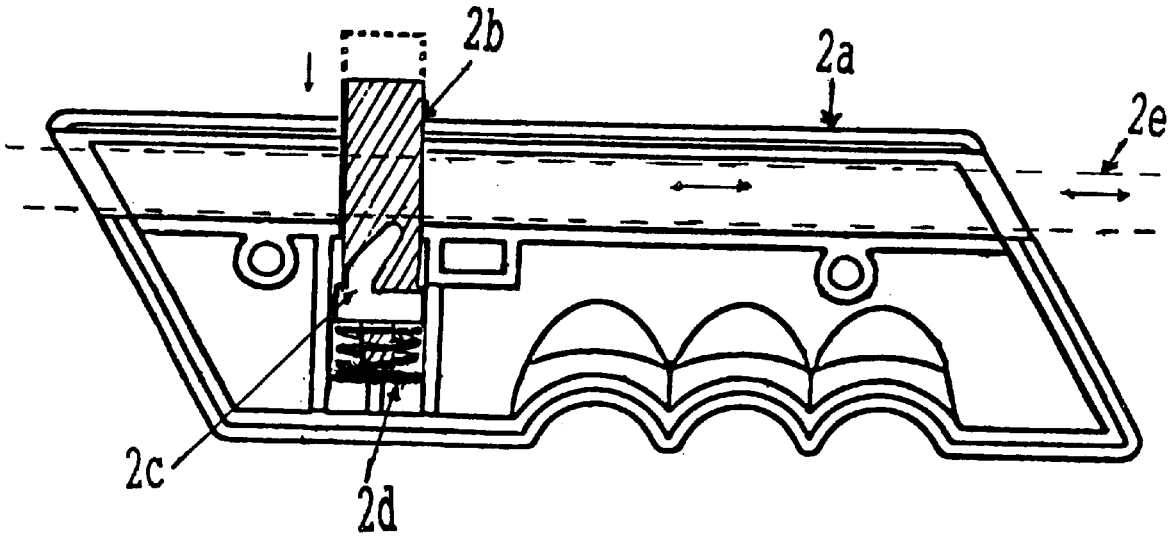
FIG. 2 is a cross section of the snugger bugger slack adjuster with the button depressed, allowing the line to move freely.
Figure 3:
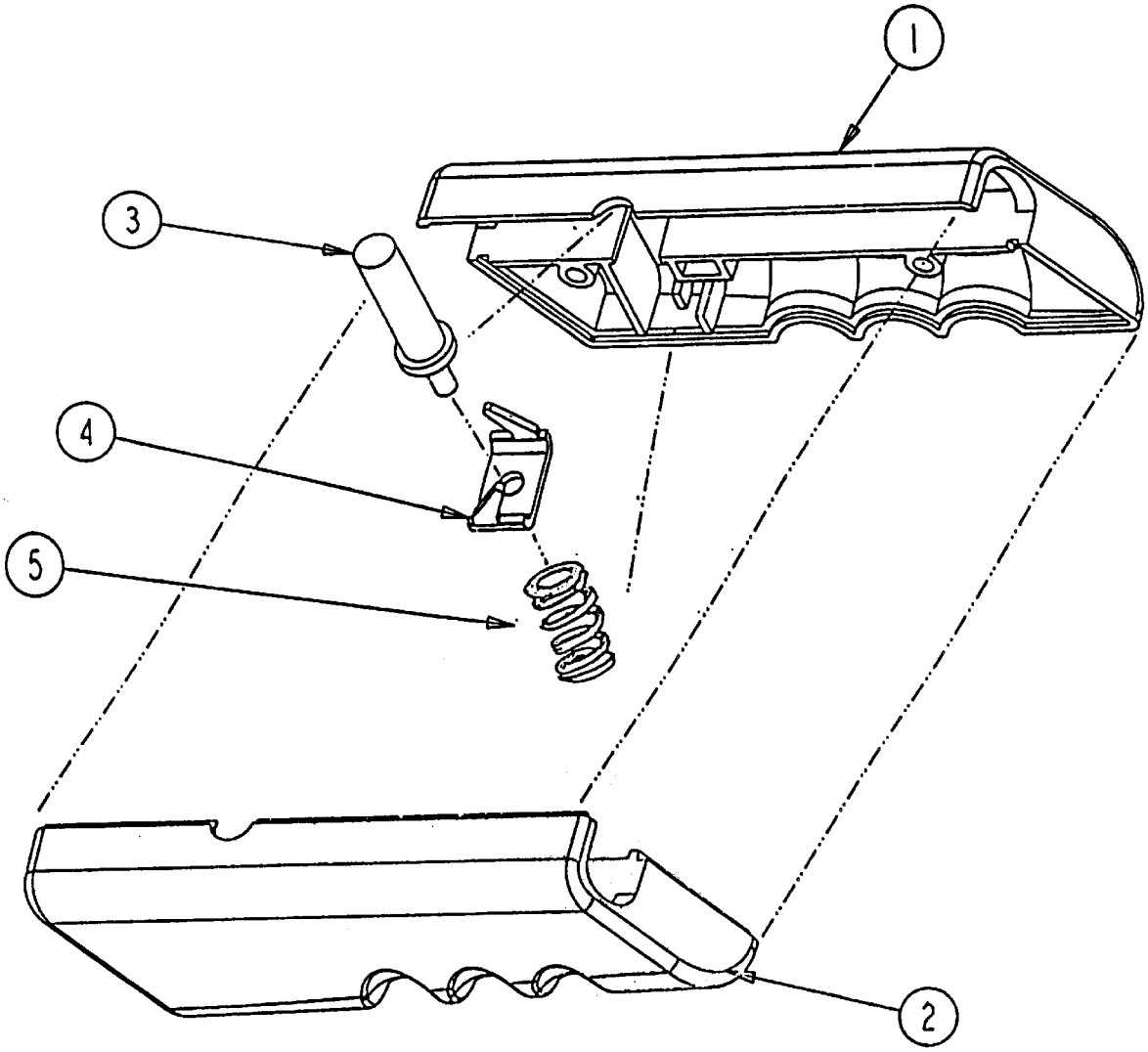
FIG. 3 is an exploded view of the snugger bugger handle.
Figure 4:
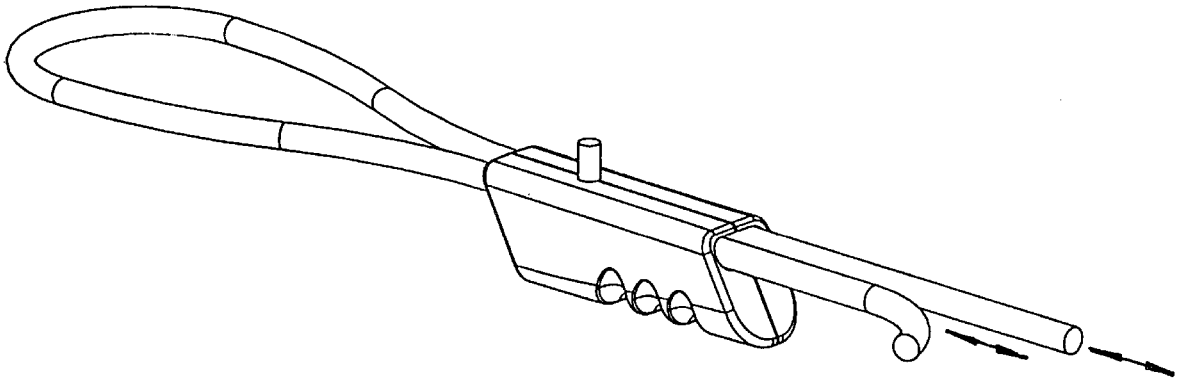
FIG. 4 is the perspective view of the snugger bugger slack adjusting handle attached to a line.
Figure 5:
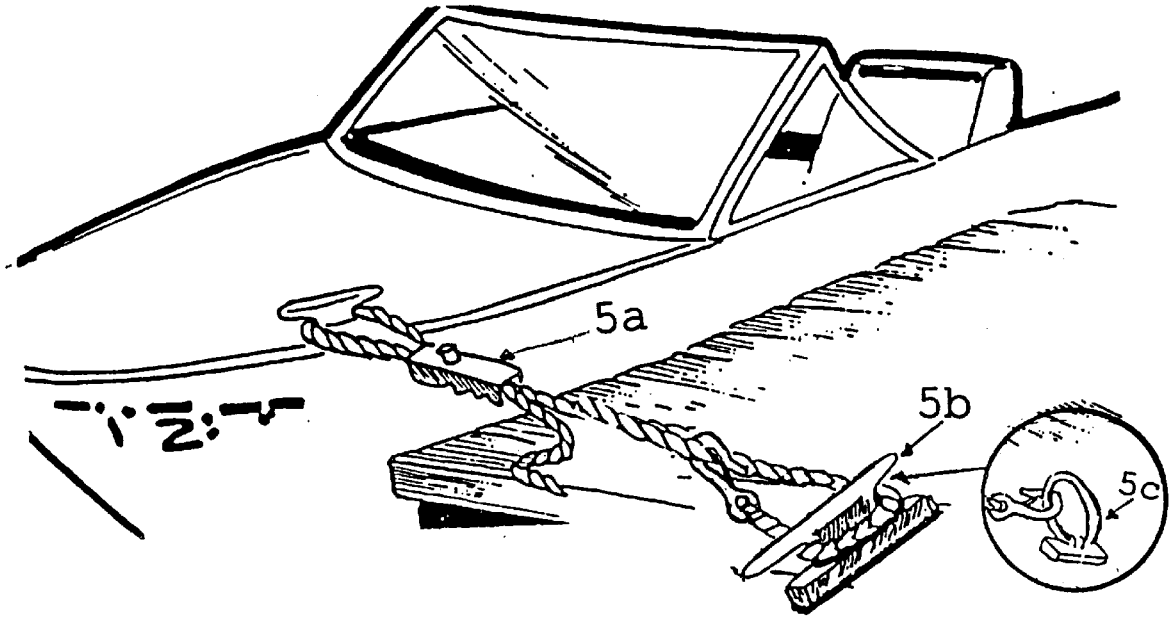
FIGS. 5*a*, 5*b* are applications of a boat line with a snugger bugger slack adjuster attached to both a ring and cleat.
Figure 6:
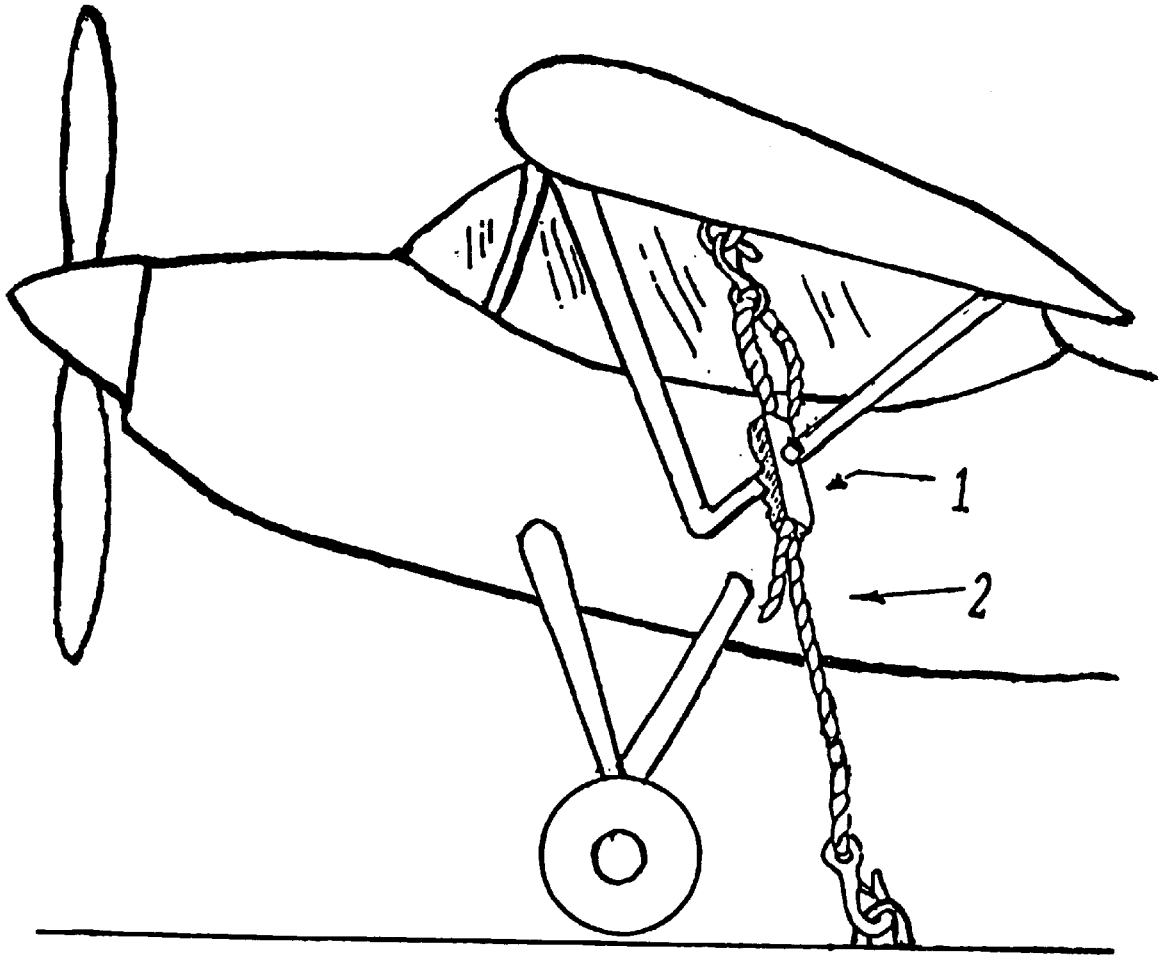
FIG. 6 is the application of the snugger bugger slack adjuster and line fixed from the airplane to the ground.

The following is a detailed description of the present invention based on a preferred embodiment shown in the accompanying drawings and it's application for boats and airplanes. FIG. 1 shows a vertical cross-section view of the snugger bugger slack adjuster handle "1*a*" with the cord or rope "1*e*" being held in place by the prong "1*c*" embedding itself when the button "1*b*" is in the free, unpressed position with the spring "1*d*" in the open or unstacked position. Notes the 45 degree of the tines of the prong "1*c*" will embed themselves when pressure is applied to the line in one direction. FIG. 2 is a vertical cross-section view of the same handle when the button "2*b*" is depressed compressing the spring "2*d*" to a stacked position freeing the prong "2*c*" from the rope "2*e*" and allowing it to move freely. FIG. 3 to the exploded view of the mechanism of he snugger bugger slack adjusting handle showing the case 1 & 2, the button 3, the prong 4, and the spring 5. FIG. 4 is the perspective view of the snugger bugger slack adjusting handle with a rope or cord in place. FIGS. 5*a*, 5*b* shows the application of the snugger bugger slack adjuster handle fixed with a rope and attached to a boat and dock cleat "5*b*". FIG. 6 shows the application of the snugger bugger slack adjusting handle "1" attached to a rope "2" of an airplane.

What is claimed is:

1. A line holder comprising:

a handle having grip means and a button located in said handle;

said button selectively actuating a prong provided with tines for engaging a pair of side-by-side lines extending through said handle;

said prong being biased by spring means into a position engaging said side-by-side lines and actuated by said button to release said lines.

2. A line holder, as in claim 1, wherein said button, when depressed, overcomes the pressure of said spring means and forces said prong to retract into a chamber provided in the interior of said handle, allowing the side-by-side lines to move freely in any direction.

3. A line holder, as in claim 1, wherein the side-by-side lines are used to secure at least one of boats, airplanes, and bundles.

4. A line holder, as in claim 1, wherein the side-by-side lines can be adjusted by depressing said button and locked in place by releasing said button.

* * * * *